United States Patent [19]

Yamada et al.

[11] 4,121,045

[45] Oct. 17, 1978

[54] CORONA SHIELDING BY JUMPER ASSEMBLY

[75] Inventors: Mankichi Yamada, Inazawa; Hiroshi Fujita, Inuyama, both of Japan

[73] Assignee: NGK Insulators, Ltd., Nagoya, Japan

[21] Appl. No.: 831,284

[22] Filed: Sep. 7, 1977

[30] Foreign Application Priority Data

Sep. 13, 1976 [JP] Japan ..... 52-108830

[51] Int. Cl.[2] ..... H01B 17/44; H01B 17/48

[52] U.S. Cl. ..... 174/141 R; 174/43; 174/140 CR

[58] Field of Search ..... 174/40 R, 43, 140 R, 174/140 H, 140 CR, 141 R, 144, 149 R, 150

[56] References Cited

FOREIGN PATENT DOCUMENTS 180,319 11/1954 Austria ..... 174/43

*Primary Examiner*—Laramie E. Askin

*Attorney, Agent, or Firm*—Stevens, Davis, Miller & Mosher

[57] ABSTRACT

A corona shield employing a jumper assembly is provided for tension insulator strings which comprises a plurality of jumper wires extending over the energized ends of an insulator string for shielding the ends thereof and line hardware on the energized side, thereby preventing corona discharge therefrom.

3 Claims, 3 Drawing Figures

CORONA SHIELDING BY JUMPER ASSEMBLY

BACKGROUND OF THE INVENTION (1) Field of the Invention

The present invention relates to a jumper assembly for tension insulator strings, and more particularly to shielding by jumper assembly for preventing corona discharge occurring on the energized side of tension insulator strings mainly for extra-high voltage overhead transmission lines.

(2) Description of the Prior Art

Recently, as the capacity of the electric power transmission has generally been greatly increased, the insulator assemblies for high voltage transmission have become large in size. In general, these insulator assemblies have shield rings for preventing corona discharge or arcing horns for protecting insulators from power arc and preventing corona discharge. With such large-sized insulator assemblies and particularly tension insulator strings, large-sized shield rings must be provided for preventing corona discharge from the insulator strings because of the reduced shielding effect of the conductors. Such a large shield ring, however, has a disadvantage in that the corona characteristics of the shield ring itself become degraded contrary to what is expected due to corona discharge from water droplets on the shield ring under wet conditions.

To overcome this disadvantage, it has been suggested that the shield ring be made as a multiple shape in the form of a cage having a large outer diameter. However, a shield ring of this type is not practical because it is difficult to install, expensive to manufacture, and is likely to be covered with snow.

SUMMARY OF THE INVENTION

It is an object of this invention to overcome the above described difficulties heretofore encountered in corona shields for tension insulator strings.

It is another object of the invention to provide an improved corona shielding by jumper assembly which improves the corona characteristics of insulator strings without using particularly large-sized shield rings while simplifying the construction work of the insulator assemblies.

The corona shielding by jumper assembly according to the invention comprises a plurality of jumper wires extending over ends of insulator strings for shielding the ends of said insulator strings including line hardware on the energized side.

In another aspect, the corona shielding by jumper assembly according to the invention comprises spacers for connecting the jumper wires to each other.

BRIEF DESCRIPTION OF THE DRAWING

These and other objects and advantages of the invention may be readily ascertained by referring to the following description and appended drawings in which.

DESCRIPTION OF THE PREFERRED EMBODIMENTS

In general, jumper wires are branched off at compression clamps at the ends of conductors connected to the energized side of the insulator strings.

Figure 1:
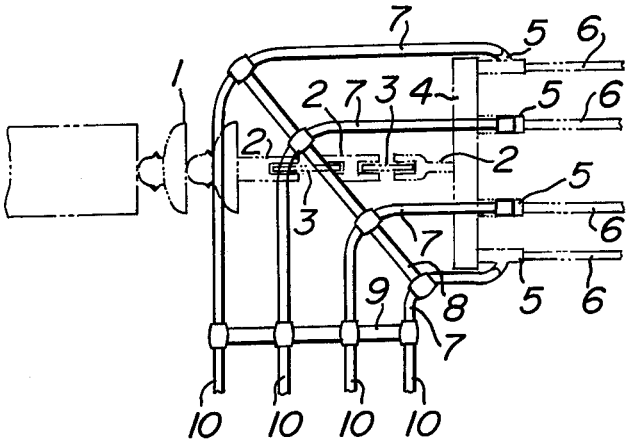
FIG. 1 is a side elevation of one embodiment of the corona shielding by jumper assembly according to the invention.
Figure 2:
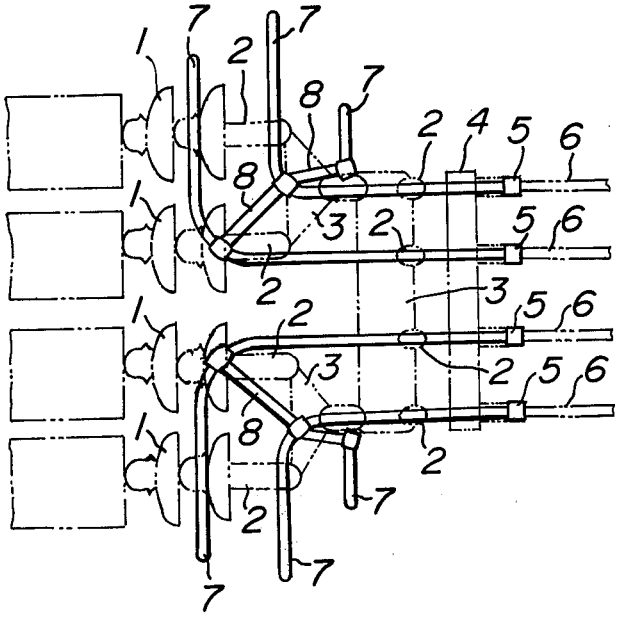
FIG. 2 is a plan view of the corona shielding by jumper assembly shown in FIG. 1.
Figure 3:
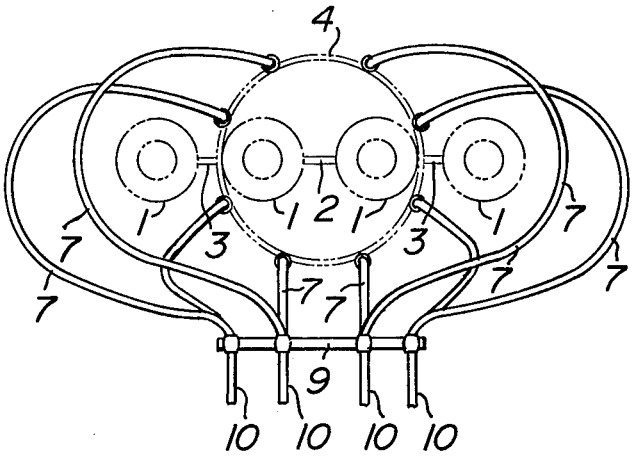
FIG. 3 is a front elevation of the corona shielding by jumper assembly shown in FIG. 1.

In FIGS. 1–3 illustrating the embodiment of the invention, insulator strings 1 gathered together by connecting fittings or line hardware 2 and yokes 3 and a plurality of conductors 6 anchored by compression clamps 5 are connected by wire anchoring yokes 4. With the insulator assembly, jumper wires 7 extend from the compression clamps 5 so as to be spaced apart from each other by suitable distances and to surround the ends of the insulator strings and the line hardware on the energized sides in extension directions of the conductors by means of jumper wire supporting spacers 8. The jumper wires 7 which have reached the energized end of the insulator strings and line hardware, further extend downwardly with suitable curvatures so as to form a bulged or swelled shape. The jumper wires are gathered together at the end of the swelled shape to have suitable distances by means of jumper gathering spacers 9. Thus gathered jumper wires 10 may extend in suitable catenaries to the insulator strings on the opposite side of the relevant insulator strings.

Though the eight jumper wires 7 are provided shown in the embodiment in FIGS. 1–3, the number of the jumper wires may be increased or decreased as the case may be. The numbers of conductors 6 and jumper wires 7 and 10 may not necessarily be equal. The jumper wires 7 may not necessarily be formed integrally with the jumper wires 10 for the purpose of further facilitating handling them when constructing the transmission line.

The corona shielding by jumper assembly thus assembled according to the invention can improve the corona characteristics of insulator strings without using particularly large-sized shield rings and serves to simplify the construction work of the insulator strings, so that the jumper assembly according to the invention will greatly contribute to the progress of the industries.

While the described embodiment represents the preferred form of the present invention, it is considered that modifications will be made by those skilled in the art without departing from the spirit of the invention. The scope of the invention is therefore to be determined solely by the appended claims.

What is claimed is:

1. An apparatus for corona shielding a plurality of tension insulator strings coupled to a plurality of conductors by line hardware comprising a plurality of jumper wires connected with said conductors and spaced apart from each other so as to surround the ends of said insulator strings on the energized side and shield said ends and line hardware, thereby preventing corona discharge therefrom.

2. An apparatus for corona shielding as set forth in claim 1, wherein said jumper wires are connected to each other by means of first spacers.

3. An apparatus for corona shielding as set forth in claim 2, wherein said jumper wires further extend downwardly in suitable curvatures so as to form a swelled shape and are gathered together at their ends spaced a predetermined distance apart by means of second spacers.

* * * * *